US005497519A

United States Patent [19]

Mintz

[11] Patent Number: 5,497,519

[45] Date of Patent: Mar. 12, 1996

[54] ORTHOPEDIC BODY PILLOW

[76] Inventor: Alan I. Mintz, 21 Sintsink Dr. W, Port Washington, N.Y. 11050

[21] Appl. No.: 267,807

[22] Filed: Jun. 28, 1994

[51] Int. Cl.[6] ..... A47C 20/00

[52] U.S. Cl. ..... 5/648; 5/632; 5/644

[58] Field of Search ..... 5/630, 632, 648, 5/650, 651, 655, 644; 128/845, 882

[56] References Cited

U.S. PATENT DOCUMENTS

| | | | |
|---|---|---|---|
| 3,308,489 | 3/1967 | Winkler | 5/648 |
| 3,626,526 | 12/1971 | Viel . | |
| 4,071,031 | 12/1978 | Lowman | 5/648 X |
| 4,665,573 | 5/1987 | Fiore . | |
| 4,688,283 | 8/1987 | Jacobson et al. . | |
| 4,754,510 | 7/1988 | King | 5/648 X |
| 5,012,539 | 5/1991 | Grigg | 5/644 |
| 5,125,123 | 6/1992 | Engle | 5/648 |
| 5,173,979 | 12/1992 | Nennhaus | 5/644 X |
| 5,245,719 | 9/1993 | Ott . | |

*Primary Examiner*—Michael F. Trettel
*Attorney, Agent, or Firm*—Sofer & Haroun

[57] ABSTRACT

An inflatable orthopedic pillow for use by an individual while sleeping in a lateral position. The pillow elevates one leg relative to the other leg, when the person is resting in a lateral position on a substantially planar support surface. The pillow has a pillow body and one or more inflatable chambers disposed within the pillow body for supporting one leg of the person. The chambers are selectively inflatable for supporting one of the legs in the second plane. Thus, the spine is straightened and disposed substantially parallel to the support surface when the person is oriented in the lateral position.

10 Claims, 2 Drawing Sheets

ORTHOPEDIC BODY PILLOW

FIELD OF THE INVENTION

This invention relates generally to an inflatable orthopedic pillow for elevating a first leg of a person relative to a second leg, the inflatable orthopedic pillow having a pillow body selectably positionable underneath a person's leg and an inflatable chamber disposed within the pillow body for supporting the first leg of the person, the chamber being selectably inflatable for disposing the spine in an orientation substantially parallel to the support surface when the person is oriented in a lateral position.

BACKGROUND OF THE INVENTION

The present invention relates generally to an inflatable orthopedic pillow for elevating a first leg of a person relative to a second leg. Specifically, when a person is resting in a lateral position (i.e. lying on his side) on a substantially planar support surface, such as a bed mattress, futon, etc., the second leg is supported by the support stirface and is disposed in a first plane defined by the support surface. The inflatable orthopedic pillow is selectably positionable underneath the first leg. When positioned underneath the first leg, the pillow supports the first leg of the person in a second plane which is substantially parallel to the first plane. As well, when positioned between the person's legs, the pillow also provides support for the first leg thereby orienting the first leg parallel to the second leg.

The inflatable orthopedic pillow utilizes an inflatable chamber which is disposed within the pillow body and which elevates the first leg of the person relative to the second leg. Accordingly, the chamber is selectably inflatable for providing support and for orienting the first leg in the second plane with the first leg being elevated relative to the substantially planar support surface and to the second leg. As such, the person's spine is disposed in an orientation substantially parallel to the support stirface when the person is oriented in a lateral position.

Numerous body support structures and pillows are disclosed in the art. However, prior art attempts have suffered from a variety of various drawbacks and deficiencies.

For example, U.S. Pat. No. 3,626,526 to Viel relates to a mattress having a base consisting of a soft layer of soft resilient expanded foam material over which is arranged a further layer of a similar material, from which layer portions have been removed or are absent to produce a mattress in which parts of the surface are at an elevation above the level of the remainder. The elevated parts are arranged so that the mattress supports the body of the user when either in the dorsal or lateral positions in an anatomically advantageous manner. The absent portion of the overlying layer may be filled with material of greater softness and resilience then the remainder of the layer. The removed portions may be attached to the elevated parts to increase the difference in elevation between the different parts of the mattress. However, there is no disclosure in the reference of an inflatable orthopedic pillow having a pillow body selectably positionable underneath a first leg as well as an inflatable chamber disposed within the body pillow for supporting the first leg of the person and for disposing the spine in an orientation substantially parallel to the support surface when the person is oriented in a lateral position.

U.S. Pat. No. 4,665,573 to Fiore is directed to a contoured body support apparatus having an upper surface contoured to maintain the spine of a person lying horizontal on the mattress in the proper curvature regardless of whether the person is lying in the supine, prone or side position. Specifically, the upper surface is provided with a convex shape in each of the lumbar and knee regions and has a concave depression in the sacral region with reduced tapering end portions from the lumbar and knee regions to the ends of the support. This reference, however, does not teach the use of an inflatable orthopedic pillow for elevating a first leg of a person comprising a pillow body selectable positionable underneath the first leg and an inflatable chamber disposed within the body pillow for disposing the spine in orientation substantially parallel to the support surface when the person is oriented in a lateral position.

U.S. Pat. No. 4,688,283 to Jacobson relates to a mattress which conforms to an individual's body profile. Specifically, the mattress or pad contours and conforms to the body profile of a reclining individual. The preferred embodiment contains flexible, airtight chambers, at least two of which are interconnected to allow the transfer of air or liquid. Interconnected chambers are positioned and dimensioned to conform to and support the natural curves of a reclining body. This reference, however, does not teach an inflatable orthopedic pillow for elevating a first leg of a person relative to a second leg when the person is resting in a lateral position. Specifically, this reference does not teach a body pillow selectably positionable underneath the first leg, for supporting the first leg of the person in a second plane substantially parallel to the first plane and an inflatable chamber disposed within the body pillow for supporting the first leg of the person, the chamber being selectably inflatable for providing support and for orienting the first leg in the second plane. Moreover, this reference does not teach the use of an inflatable chamber which provides for the elevation of the first leg relative to the substantially planar support surface and to the second leg as well as the disposition of the spine in an orientation substantially parallel to the support surface when the person is oriented in a lateral position.

U.S. Pat. No. 5,245,719 to Ott is directed to an inflatable support apparatus for a human torso. Specifically, the apparatus is provided in the general form of a catamaran which provides a tunnel extending longitudinally of the support within which additional supporting members can be confined. However, there is no disclosure in the reference of an inflatable orthopedic pillow having a pillow body selectably positionable underneath or between a first leg as well as an inflatable chamber disposed within the pillow body for supporting the first leg of the person and for disposing the spine in an orientation substantially parallel to the support surface when the person is oriented in a lateral position.

Thus, none of the prior art teaches or suggests an inflatable orthopedic pillow having a body pillow selectably positionably underneath a first leg or between first and second legs for supporting the first leg of a person in a second plane substantially parallel to the first plane and an inflatable chamber disposed within the body pillow for supporting the first leg of the person. Moreover, none of the prior art teaches a chamber being selectably inflatable for providing support and for orienting the first leg in the second plane as well as the first leg being elevated relative to the substantially planar support surface and to the second leg, and for disposing the spine in an orientation substantially parallel to the support surface when the person is oriented in a lateral position.

It is, therefore, an object of the present invention, to provide an inflatable orthopedic pillow for disposing the spine in an orientation substantially parallel to the support surface when the person is oriented in a lateral position.

Another object of the invention is to provide a body pillow having a length substantially equal to the length of a user's legs.

A further object of the invention is to provide an inflatable chamber disposed within the body pillow for supporting the thigh of the first leg of the person, the chamber being selectively inflatable for providing support and for orienting the thigh of the first leg in the second plane.

Another object of the invention is to provide a second inflatable chamber disposed within the pillow body for supporting the knee of the first leg of the person, the chamber being selectably inflatable for providing support and for orienting the knee of the first leg in the second plane.

A further object of the invention is to provide a third inflatable chamber disposed within the pillow body for supporting the ankle of the first leg of the person, the chamber being selectably inflatable for providing support and for orienting the ankle of the first leg in the second plane.

An additional object of the invention is to provide an orthopedic pillow having an inflatable chamber disposed within the pillow body, the pillow selectively positionable between the first and second legs so that the first leg is elevated relative to the substantial planar support surface and directly above the second leg, thereby disposing the spine in orientation substantially parallel to the support surface.

Other objects and features of the present invention will become apparent from the following detailed description considered in conjunction with the accompanying drawings. It is to be understood, however, that the drawings are designed solely for purposes of illustration and not as a definition of the limits of the invention, for which reference should be made to the appended claims.

SUMMARY OF THE INVENTION

In accordance with the invention, an inflatable orthopedic body pillow is provided with one or more inflatable air chambers. In this way, when a user is sleeping horizontally on a bed on a user's side, i.e. in a lateral position, one of the user's legs is elevated relative to the plane of the bed thereby orienting the user's spinal column substantially parallel to the plane of the bed.

Specifically, the inflatable orthopedic pillow which is provided with one or more inflatable air chambers, provides support for the user's first leg. In order to provide ankle support, a first bladder may be positioned underneath the ankle. Similarly, in order to provide knee support, a second bladder may be positioned beneath the knee. A third bladder may be positioned underneath the thigh to provide further support of the thigh. When any combination or all of the inflatable bladders are activated, the user's leg is elevated, separating the user's legs, and thus allowing the spinal column to be aligned relative to the horizontal axis parallel to the axis of the bed.

More specifically, when the person or user rests in a lateral position on a substantially planar support surface, i.e. bed, mattress, futon, floor, etc., the second leg is supported by the substantial planar support surface and disposed in a first plane defined by the support surface. Additionally, the inflatable orthopedic pillow comprises a pillow body selectively positionable underneath the first leg for supporting the first leg of the person in a second plane substantially parallel to the first plane and an inflatable chamber disposed within the pillow body for supporting the first leg of the person. The pillow body can be made out of any suitable bedding material such as down, foam, cotton, polyester, etc. The chamber, which can be filled with any desired fluid i.e. air, hot water, gel, is selectively inflatable for providing support and for orienting the first leg in the second plane. In this way, the user's chest and shoulders are aligned relative to the axis of the bed when the first leg is elevated relative to the substantially planar support surface, thereby disposing the spine in an orientation substantially parallel to the support surface when the person is oriented in the lateral position. Additionally, the length of the body pillow can be equal to, less than or greater than the length of the person's legs.

In the currently preferred implementation, the inflatable orthopedic pillow is provided with a pillow body, a first inflatable chamber, and a second inflatable chamber. In this way, the first inflatable chamber is disposed within the pillow body for supporting the thigh of the first leg of the person, the chamber being selectively inflatable for providing support and for orienting the thigh of the first leg in the second plane. The second inflatable chamber is disposed within the pillow body for supporting the knee of the first leg of the person. Similar to the first chamber, the second chamber is selectively inflatable for providing support and for orienting the knee of the first leg in the second plane. Additionally the third inflatable chamber is also disposed within the pillow body for supporting the foot or ankle of the first leg of the person. Similar to the first and second chambers, the third chamber is selectively inflatable.

In another currently preferred implementation, the pillow body of the inflatable orthopedic pillow is positioned between the legs thus supporting the first leg of the person in a second plane substantially parallel to the first plane and directly above the second leg. In this way, one or more inflatable fluid chambers disposed within the pillow body provide support for the thigh, knee or foot of the first leg of the person. Each of these chambers may be selectively inflated thereby providing support for the first leg and elevating it into the second plane. Most importantly, by orienting the first leg substantially parallel to the support surface and directly above the second leg, the spine is disposed in an orientation substantially parallel to the support surface when the person is oriented in the lateral position thus providing the person with a comfortable night's sleep and a pain free morning.

A method of elevating a first leg of a person relative to the second leg is also disclosed. Specifically, when the person rests in a lateral position on a substantially planar support surface, the second leg is supported by the substantially planar support surface and disposed in a first plane defined by the substantially planar support surface. Specifically, the inflatable orthopedic pillow is positioned underneath the leg for supporting the leg of the person. A chamber is disposed within the orthopedic pillow and is selectively inflated, elevating the first leg relative to the support surface and to the second leg thereby disposing the spine in an orientation substantially parallel to the support surface.

The invention accordingly describes the features and method of use, the combination of elements and the arrangements of parts which will be exemplified in the embodiments hereinafter set forth, the scope of the invention being indicated by the appended claims.

BRIEF DESCRIPTION OF THE DRAWINGS

In the drawings, wherein like reference numerals denote similar elements throughout several views.

DETAILED DESCRIPTION OF THE PRESENTLY PREFERRED EMBODIMENTS

The human spine with its many vertebrae, separated from each other by resilient disks and having nerves branching out from openings between adjacent vertebra, is the source of many of mankind's aches and pains. In order to prevent many back pains, it is important to maintain the spine in its natural curvature during periods of rest, principally while sleeping. To do so, certain positions of the body must be supported when the person is resting on his back, on his stomach (prone), or on his side (lateral). Accordingly, an inflatable orthopedic body pillow constructed in accordance with the present invention for use when a user is lying on a bed on the user's side, includes one or more inflatable air chambers for elevating one of the user's legs relative to the plane of the bed thereby orienting the user's spine substantially parallel to the plane of the bed. Specifically, the orthopedic pillow is provided with one or more inflatable air chambers or bladders. Accordingly, when any one or more of the inflatable bladders are activated, the user's legs are separated, thus allowing the spinal column to be aligned and parallel to the plane of the bed.

Figure 1:
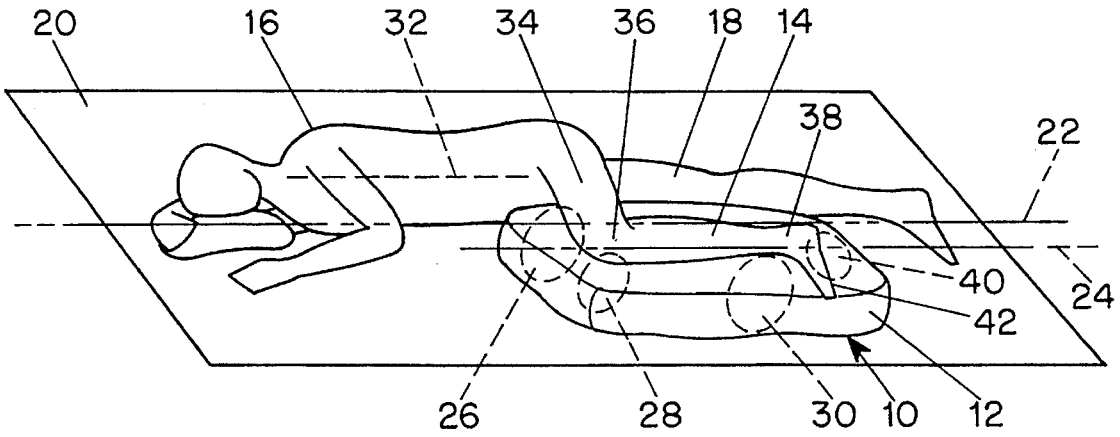
FIG. 1 is an elevated perspective view of an inflatable body pillow constructed in accordance with the teachings of the present invention.

Referring specifically to FIG. 1 of the drawings, a preferred embodiment of an inflatable orthopedic pillow 10 in accordance with the invention includes a resilient body pillow 12 and one or more inflatable chambers 26, 28 and 30 disposed within the pillow body 12. Specifically, the inflatable orthopedic pillow 10 is used for elevating a first leg 14 of a person 16 relative to a second leg 18 when the person 16 is resting in a lateral position on a substantially planar support surface such as a bed or mattress 20. The second leg 18 is supported by the substantially planar support surface 20 and is disposed in a first plane 22 defined by the support surface 20.

The pillow body 12 of the inflatable orthopedic pillow 10 is selectively positionable underneath the first leg 14 for supporting the first leg 14 of the person 16 in a second plane 24 which is substantially parallel to the first plane 22. The resilient pillow body 12 can be made of polyester foam or other suitable material such as polyester fill, terry cloth, cotton fiber fill or down. Preferably, the length of the pillow body 12 is substantially equal to that of the person's legs.

As shown in FIG. 1, first 26, second 28 and third 30 inflatable chambers are disposed within the pillow body 12 for supporting the first leg 14 of the person 16. The chambers 26, 28 and 30 are selectively inflatable for providing support and for elevating the first leg 14 into the second plane 24. As such, the first leg 14 is elevated relative to the support surface 20 and to the second leg 18 and thus straightens the person's spine 32 and disposes it substantially parallel to the support surface 20 when the person 16 is oriented in a lateral position as shown in FIG. 1.

The first inflatable chamber 26 the pillow body 12 is provided for supporting the thigh 34 of the first leg 14 of the person 16. This first inflatable chamber 26 is selectively inflatable for providing support for the thigh 34 of the first leg 14 and orienting it in the second plane 24. Additionally, the second inflatable chamber 28; which is disposed within the pillow body 12, supports the knee 36 of the first leg 14 of the person 16, the second chamber 28 being selectively inflatable for providing support for the knee 36 of the first leg 14 and orienting it in the second plane 24. As well, the third inflatable chamber 30 is also disposed within the pillow body 12 and provides support for the ankle 38 of the first leg 14 of the person 16. Like the first and second inflatable chambers 26, 28, the third inflatable chamber 30 is also selectively inflatable for supporting the ankle 38 of the first leg 14 and orienting it in the second plane 24. If desired, a fourth inflatable chamber 40 may be provided within the pillow body 12 for supporting the foot 42 of the first leg 14 of the person 16. This fourth chamber may be selectively inflatable for orienting the foot 42 of the first leg 14 in the second plane 24.

Figure 2:
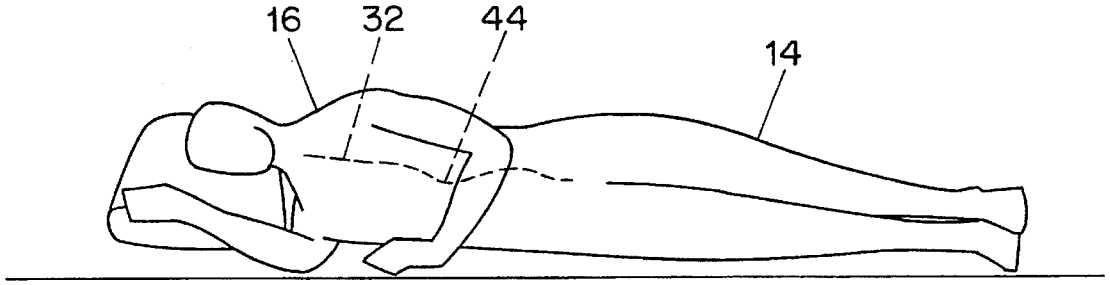
FIG. 2 is a diagrammatic side view of an individual in a lateral position without the inflatable orthopedic pillow.
Figure 3:
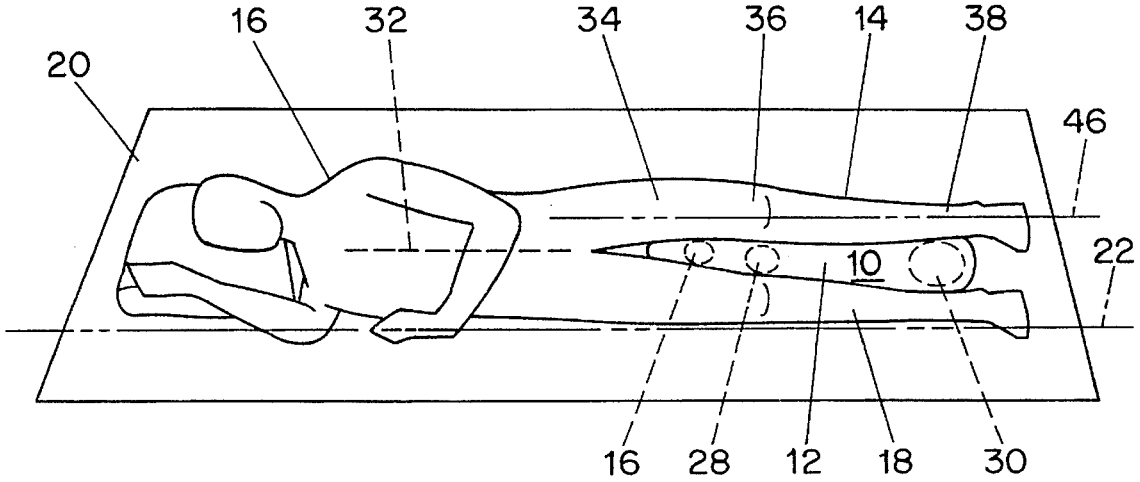
FIG. 3 is a diagrammatic perspective view of the inflatable orthopedic body pillow positioned between the person's legs, the pillow having first, second and third inflatable chambers disposed within the pillow body.
Figure 4:
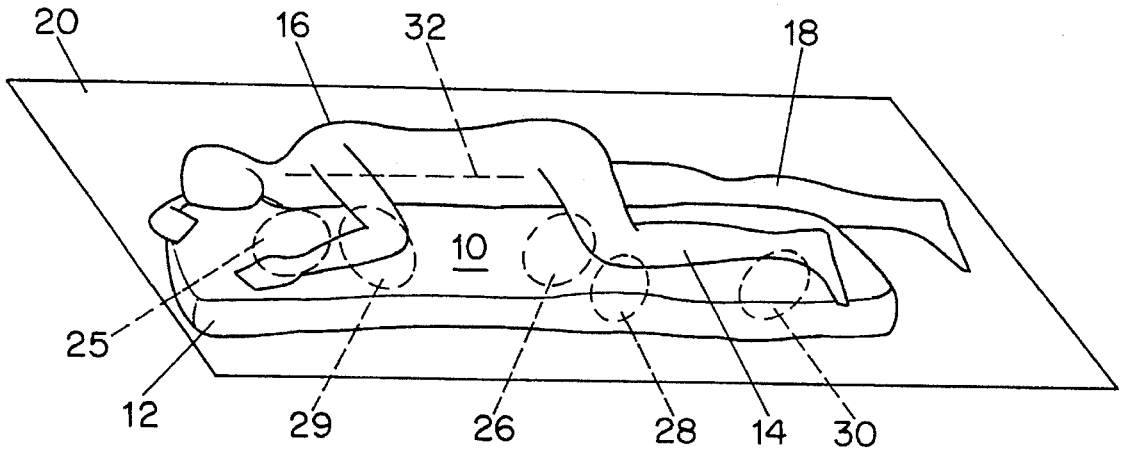
FIG. 4 is a perspective view of the inflatable orthopedic pillow showing first, second and third inflatable chambers disposed within the pillow body.

FIG. 2 represents a position in which a person 16 is lying in a lateral position on an ordinary mattress 20 wherein the person's first leg 14 is not supported by the inflatable orthopedic pillow 10. Specifically and as shown in FIG. 2, the first leg 14 is not supported by the inflatable orthopedic pillow 10 and thus lumbar curvature 44 of the spine 32 is evident. To correct this anatomically incorrect position, as shown in FIGS. 1, 3, 4, 5 and 6 the body pillow 12 is provided with one or more inflatable air chambers. Although three air chambers (26, 28 and 30) are shown in FIGS. 3 and 4, one or even two inflatable air chambers may be used and may be positioned anywhere underneath the person's 16 first leg 14. In this way, the person's 16 first leg 14 is elevated relative to the plane of the bed 20 when the person is sleeping.

FIG. 3, which shows the person in a lateral position, shows another embodiment of the inflatable orthopedic pillow 10 wherein the pillow body 12 is selectively positionable between the first 14 and second 18 legs for supporting the first leg 14 of the person in a second plane 46 substantially parallel to the first plane 22 and directly above the second leg 18. Specifically, the inflatable orthopedic pillow 10 includes a pillow body 12 which is selectably positionable between the first 14 and the second 18 legs for supporting the first leg of the person in the second plane 46. The second plane 46 is substantially parallel to the first plane 22 and is directly above both the second leg 18 and the first plane 22. Similar to the embodiment described in the FIG. 1, one or more inflatable chambers are disposed within the pillow body 12 for supporting the thigh 34, knee 36, and ankle 38 of the first leg 14 of the person 16. Accordingly, the spine 32 is disposed in an orientation substantially parallel to the support surface 20 when the person 16 is oriented in a lateral position.

FIG. 4 represents the inflatable orthopedic pillow 10 wherein the length of the pillow body 12 is substantially equal to the length of the person 16. Similar to FIG. 1, first 26, second 28, and third 30 inflatable chambers are disposed within the pillow body 12 and are selectively inflatable for providing support and for orienting the first leg 14 in the second plane 24. Although three inflatable chambers are shown, one or more inflatable chambers depending on the user's needs may be utilized. In this way, the first leg 14 is elevated relative to the support surface 20 and to the second leg 18. Thus, the spine 32 is substantially parallel to the support surface 20 when the person 16 is oriented in a lateral position. Additionally, fourth 25 and fifth 29 inflatable chambers may be disposed within the pillow body 12. In this way, the fourth inflatable chamber 25 is utilized for supporting the person's shoulders. As well, the fifth inflatable chamber 29 may be utilized for support of the user's chest.

Figure 5:
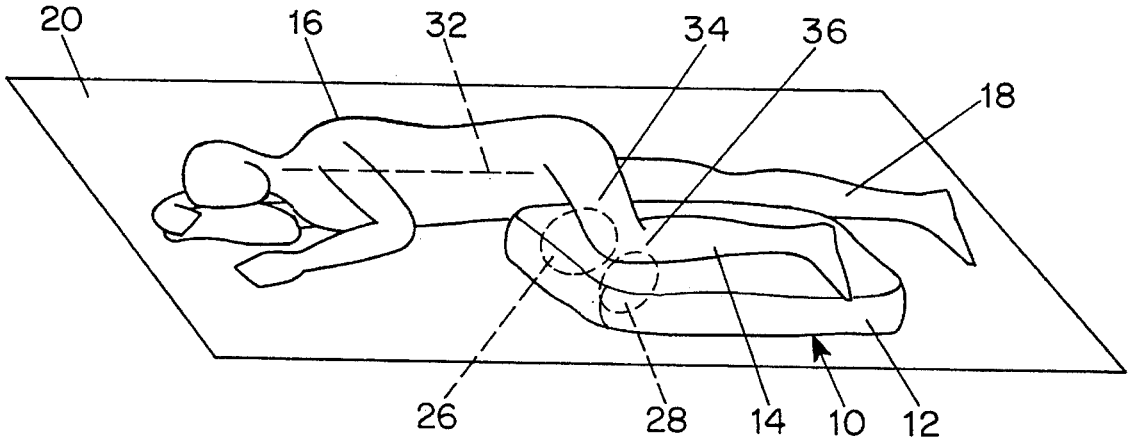
FIG. 5 is a perspective view of the inflatable orthopedic pillow of FIG. 1 having first and second inflatable chambers disposed within the pillow body.

FIG. 5 shows the inflatable orthopedic pillow having a pillow body 12 as well as first 26 and second 28 inflatable chambers. Similar to the embodiment described in FIG. 1, the first inflatable chamber 26 is disposed within the pillow body 12 and provides support for the thigh 34 of the first leg 14 of the person 16. As well, the second inflatable chamber 28 is also disposed within the pillow body 12 and provides support for the knee 36 of the first leg 14 of the person. In this way, both the first and second inflatable chambers 26, 28 are selectively inflatable for providing support and for elevating the thigh 34 and knee 36 relative to the support surface 20 and to the second leg 18. Thus, the spine 32 is substantially parallel to the support surface 20 when the person is oriented in a lateral position.

Figure 6:
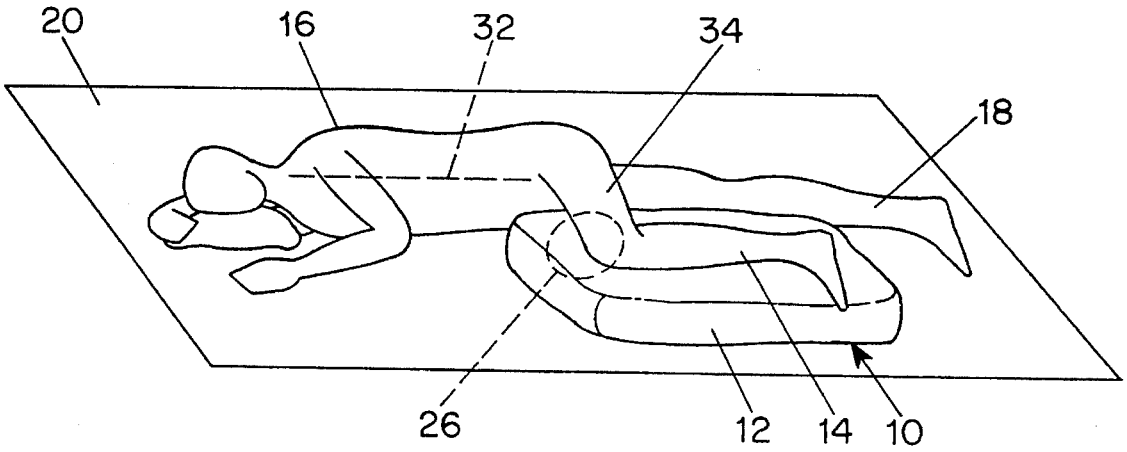
FIG. 6 is a perspective view of the inflatable orthopedic pillow of FIG. 1 having a first inflatable chamber disposed within the pillow body.

FIG. 6 shows a similar configuration as described in FIG. 5 except that only one inflatable chamber 26 disposed within the pillow body 12 is provided for supporting the thigh 34 of the first leg 14 of the person 16. The embodiment described in FIG. 6 operates in a similar fashion to that described in the embodiment of FIG. 1.

It should be understood that the preferred embodiments and examples described are for illustrative purposes only and are not to be construed as limiting the scope of the present invention which is properly delineated only in the appended claims.

What is claimed is:

1. An inflatable orthopedic pillow for elevating a first leg of a person relative to a second leg, the person resting in a lateral position on a substantially planar supporting surface, the second leg being supported by the substantially planar support surface and disposed in a first plane defined by said substantially planar support surface, said inflatable orthopedic pillow comprising:

a resilient pillow body defining an interior volume selectably positionable underneath the first leg for supporting the first leg of the person in a second plane substantially parallel to the first plane, wherein said interior volume of said resilient pillow body may be selected from the group consisting of down, foam, cotton or polyester; and an inflatable chamber disposed within said interior volume of said pillow body for supporting the first leg of the person, said chamber being selectively inflatable for providing support and for orienting the first leg in the second plane, the first leg being elevated relative to the substantially planar support surface and to the second leg, and for disposing the spine in an orientation substantially parallel to the support surface when the person is oriented in the lateral position.

2. The inflatable orthopedic pillow of claim 1, wherein the length of the pillow body is substantially equal to the length of the person's leg.

3. The inflatable orthopedic pillow of claim 1, wherein said inflatable chamber disposed within said pillow body is provided for supporting the thigh of the first leg of the person, said chamber being selectively inflatable for providing support and for orienting the thigh of the first leg in the second plane.

4. The inflatable orthopedic pillow of claim 3, further comprising a second inflatable chamber disposed within said pillow body for supporting the knee of the first leg of the person, said chamber being selectively inflatable for providing support and for orienting the knee of the first leg in the second plane.

5. The inflatable orthopedic pillow of claim 4, further comprising a third inflatable chamber disposed within said pillow body for supporting the ankle of the first leg of the person, said chamber being selectively inflatable for providing support and for orienting the ankle of the first leg in the second plane.

6. The inflatable orthopedic pillow of claim 5, further comprising a fourth inflatable chamber disposed within said pillow body for supporting the foot of the first leg of the person, said chamber being selectively inflatable for providing support and for orienting the foot of the first leg in the second plane.

7. An inflatable orthopedic pillow for elevating a first leg of a person relative to a second leg, the person resting in a lateral position on a substantially planar support surface, the second leg being supported by the substantially planar support surface and disposed in a first plane defined by said substantially planar support surface, said inflatable orthopedic pillow comprising:

a pillow body selectably positionable between the first leg and second legs for supporting the first leg of the person in a second plane substantially parallel to the first plane;

an inflatable chamber disposed within said pillow body for supporting the thigh of the first leg of the person, said chamber being selectively inflatable for providing support and for orienting the thigh of the first leg in the second plane, the first leg being elevated substantially parallel to the substantially planar support surface and directly above the second leg, and for disposing the spine in an orientation substantially parallel to the support surface when the person is oriented in the lateral position; and a second inflatable chamber disposed within said pillow body for supporting the knee of the first leg of the person, said chamber being selectively inflatable for providing support and for orienting the knee of the first leg in the second plane, the first leg being elevated to the substantially planar support surface and to the second leg, and for disposing the spine in an orientation substantially parallel to the support surface when the person is oriented in the lateral position.

8. The inflatable orthopedic pillow of claim 7, further comprising a third inflatable chamber disposed within said pillow body for supporting the ankle of the first leg of the person, said chamber being selectively inflatable for providing support and for orienting the ankle of the first leg in the second plane.

9. A method of elevating a first leg of a person relative to a second leg, the person resting in a lateral position on a substantially, planar support surface, the second leg being supported by the substantially planar support surface and disposed in a first plane defined by said substantially planar support surface, said method comprising;

positioning an inflatable orthopedic pillow underneath the human leg for supporting the human leg of the person;

selectively inflating a first chamber disposed within said orthopedic pillow for supporting the thigh of the first leg of the person and selectively inflating a second chamber disposed within said orthopedic pillow for supporting the knee of the first leg of the person;

elevating the first leg relative to the substantially planar support surface and to the second leg; and disposing the spine in an orientation substantially parallel to the support surface.

10. The method of claim 9, wherein said step of selectively inflating a first chamber comprises the step of selectively inflating a third chamber disposed within said orthopedic pillow for supporting the foot of the first leg of the person.

* * * * *